US008308469B2

(12) United States Patent
Koizumi et al.

(10) Patent No.: US 8,308,469 B2
(45) Date of Patent: Nov. 13, 2012

(54) CLEANING DEVICE AND FINE-PARTICLE PROCESSING DEVICE THEREWITH

(75) Inventors: Ichiro Koizumi, Osaka (JP); Tadatoshi Yamamoto, Osaka (JP); Takashi Nakajima, Osaka (JP)

(73) Assignee: Fuji Paudal Conmpany Limited, Osaka (JP)

( * ) Notice: Subject to any disclaimer, the term of this patent is extended or adjusted under 35 U.S.C. 154(b) by 1092 days.

(21) Appl. No.: 12/211,976

(22) Filed: Sep. 17, 2008

(65) Prior Publication Data

US 2009/0199358 A1 Aug. 13, 2009

(30) Foreign Application Priority Data

Feb. 7, 2008 (JP) ..... 2008-027799

(51) Int. Cl.
*A47L 9/00* (2006.01)
*B28B 17/00* (2006.01)

(52) U.S. Cl. ..... 425/229; 425/332; 15/302; 15/303

(58) Field of Classification Search ..... 15/320, 15/321, 302, 303; 134/21, 6, 7, 26, 34; 425/225, 425/227, 229, 332, 333
See application file for complete search history.

(56) References Cited

U.S. PATENT DOCUMENTS

| | | | | |
|---|---|---|---|---|
| 3,775,331 | A * | 11/1973 | Borrello | 510/305 |
| 3,833,178 | A * | 9/1974 | Beck | 241/3 |
| 4,198,061 | A * | 4/1980 | Dunn | 15/1.51 |
| 4,751,759 | A * | 6/1988 | Zoell | 15/1.51 |
| 5,084,218 | A * | 1/1992 | Vos et al. | 264/3.4 |
| 5,236,512 | A * | 8/1993 | Rogers et al. | 134/1 |
| 5,603,775 | A * | 2/1997 | Sjoberg | 134/21 |
| 6,431,185 | B1 * | 8/2002 | Tomita et al. | 134/1.3 |
| 6,860,277 | B2 * | 3/2005 | Lee et al. | 134/153 |
| 7,111,797 | B2 * | 9/2006 | Bezama et al. | 239/522 |
| 7,718,009 | B2 * | 5/2010 | Verhaverbeke et al. | 134/3 |
| 2003/0205157 | A1 * | 11/2003 | Boatman et al. | 101/425 |
| 2004/0238000 | A1 * | 12/2004 | Yeo et al. | 134/1.3 |
| 2005/0126605 | A1 * | 6/2005 | Yassour et al. | 134/34 |
| 2007/0062560 | A1 * | 3/2007 | Imatani et al. | 134/2 |
| 2007/0130716 | A1 * | 6/2007 | Yamada et al. | 15/300.1 |

FOREIGN PATENT DOCUMENTS

| | | |
|---|---|---|
| JP | S41-563 | 1/1966 |
| JP | 3886165 | 2/2007 |

* cited by examiner

*Primary Examiner* — Joseph J Hail
*Assistant Examiner* — Joel Crandall

(57) ABSTRACT

In a spheronizer for transforming columnar granulated product, which is fed in a wet condition, into spherical shapes, irregularities on a top surface of a particle-regulating disc are easily clogged, in particular, in an outer circumference. In view of this, a cleaning device (32) is provided for rapidly and reliably removing wet powders adhering to the particle-regulating disc. The cleaning device (32) is provided with a cover (33) covered on a part of the outer circumference of a rotating particle-regulating disc. The cover (33) is formed with a nozzle (39). The nozzle (39) injects a fluid to a cleaning target surface covered with the cover (33). The fluid in a space formed between the cover (33) and the cleaning target surface is suctioned and discharged from a vacuum connection port (36) to the outside.

3 Claims, 10 Drawing Sheets

CLEANING DEVICE AND FINE-PARTICLE PROCESSING DEVICE THEREWITH

TECHNICAL FIELD

The present invention relates to various devices for handling fine particles (powder and/or particles), and to a cleaning device for removing the fine particles adhering to the devices.

BACKGROUND ART

As represented by Japanese Patent Application No. S41-00563 described below, a spheronizer for transforming wet columnar particles into spherical shapes is known. In the spheronizer, the columnar particles, which remain in a wet condition, as a raw material are fed into a cylindrical hollow case. On a bottom within the hollow case, a disc having engraved irregularities is rotated. Concurrently therewith, the fed wet columnar particles are smashed and transformed into spherical shapes.

As a result of the use of the spheronizer, there is a concern that the irregularities on the rotating disc are clogged with wet powders generated from the raw material. In particular, as described in Japanese Patent No. 3886165 described below, irregularities along an outer circumference of the rotating disc are easily clogged. The rotating disc of which the irregularities are clogged is inferior in the effect of regulating particles into spherical shapes, and thus, cleaning the clogged rotating disc becomes necessary.

Conventionally, the cleaning is performed in a state that an operation of the spheronizer is stopped by scraping the wet powders clogged in the irregularities of the rotating disc using a spatula or a brush. However, this operation requires a significant amount of labor and time. The scraping with the spatula or the brush may generate metal fragments which could be mixed in a product. On the other hand, when cleaning by using water is additionally applied, it is effective, but requires drying or wiping, and thereby takes a long time to complete the operation. In addition, should the water or drug solution remain, a defective product may be produced.

In view of these circumstances, in Japanese Patent No. 3886165 described below, not forming the irregularities along the outer circumference of the rotating disc has been proposed. This is intended to solve the problem by not forming the irregularities at positions most likely to be clogged.

SUMMARY OF INVENTION

Technical Problem

The outer circumference of the rotating disc is most likely to be clogged with the wet powders. Conversely, that portion can be said to be the chief location that serves the effect of regulating the particles into spherical shapes. Therefore, unlike Japanese Patent No. 3886165 in which it is intended to solve the problem by not forming the irregularities along the outer circumference of the rotating disc, it is more preferable that when the irregularities are clogged with the wet powders, the wet powders be removed rapidly and reliably while forming the irregularities along the circumference of the rotating disc.

An object to be solved by the present invention is to remove wet powders adhering to a rotating disc rapidly and reliably without decreasing an effect of regulating particles into spherical shapes. Further, in view of the fact that not only a spheronizer but also other fine-particle processing devices have a similar problem, an object of the present invention is to provide a cleaning device capable of removing wet powders adhering to a device rapidly and reliably and a fine-particle processing device including the cleaning device.

Solution to Problem

The present invention has been achieved to solve the above-described problems, and is a cleaning device including: a cover covered on a cleaning target surface to which fine particles actually adhere or possibly adhere; a nozzle for injecting a fluid to the cleaning target surface covered with the cover; and vacuum suctioning means for suctioning and discharging a fluid in a space formed between the cover and the cleaning target surface to the outside.

In addition to the above-described configuration, the present invention is a cleaning device, in which the cover is arranged as close as possible to, but not in contact with, the cleaning target surface, and moves relative to the cleaning target surface.

In addition to the above-described configuration, the present invention is a cleaning device, in which the cleaning target surface exists to be a disc or a cylinder; at a circumferential part of the disc or the cylinder, the cover is arranged; and around an axis of the disc or the cylinder, the cover is rotated relative to the disc or the cylinder.

Further, the present invention is a fine-particle processing device including a cleaning device according to any one of the above-described cleaning devices.

More specifically, according to the present invention, the fine-particle processing device is a spheronizer for transforming columnar particles, fed in a wet condition, into spherical shapes, and includes: a case having a cylindrical wall surface; a particle-regulating disc formed of a disc of which a top surface is formed with irregularities, the particle-regulating disc being rotated with an outer circumferential edge thereof being as close as possible to an inner circumferential surface of the case; at a part of an outer circumference of the particle-regulating disc, the cover being alternatively arranged in one of a cleaning position in which the cover is arranged as close as possible to, but is not in contact with, a top surface of the particle-regulating disc, and a housing position in which the cover is moved further upward or outward; the nozzle for injecting a fluid to a location covered with the cover, within the top surface of the particle-regulating disc, and the vacuum suctioning means for suctioning and discharging to the outside a fluid in the space formed between the cover and the top surface of the particle-regulating disc.

In addition to the above-described configuration, the present invention is a fine-particle processing device, in which the cover is projected inwardly from a circumferential sidewall of the case in the cleaning position, while the cover is retracted to a position at which a projected side end surface is flush with an inner circumferential surface of the case in the housing position.

In addition, the present invention is a fine-particle processing device, further including an auxiliary nozzle for injecting air into a gap between the inner circumferential surface of the case and an outer circumferential edge of the particle-regulating disc.

Advantageous Effects of Invention

According to the present invention, the wet powders adhering to the fine-particle processing device can be rapidly and reliably removed. For example, when the present invention is applied to a spheronizer, the wet powders adhering to a rotating disc can be rapidly and reliably removed without decreasing an effect of regulating particles into spherical shapes.

DESCRIPTION OF EMBODIMENTS

Next, an embodiment of the present invention is described.

A cleaning device according to the present invention is used in various devices for handling fine particles (fine-particle processing devices) to remove fine particles adhering to these devices. Examples of the fine-particle processing device include but are not limited to a particle-regulating machine, a wet or dry granulator, a dryer, a kneading machine, a mixing machine, a fluid bed machine, and a coating machine. In particular, the cleaning device according to the present invention is preferably used for a spheronizer for transforming wet columnar particles into spherical shapes.

Figure 1:
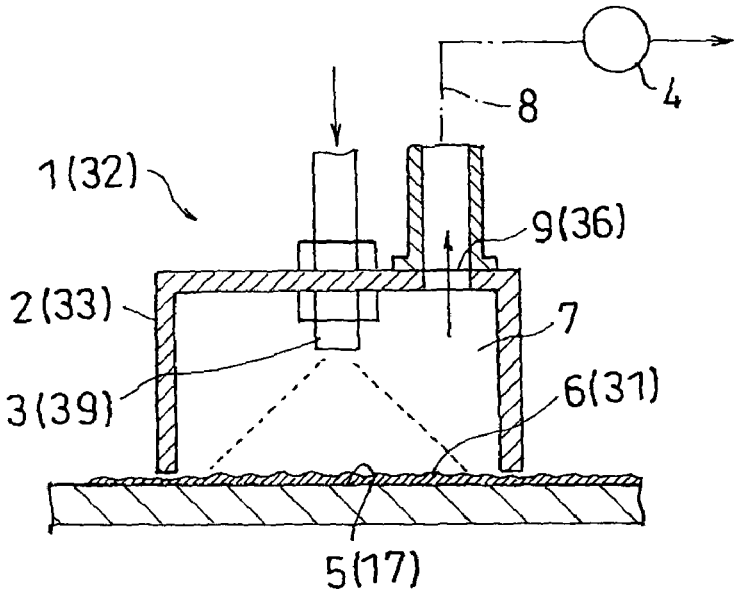
FIG. 1 is a schematic longitudinal cross-sectional view showing a usage state of one embodiment of a cleaning device of the present invention.

According to one embodiment of the present invention, a cleaning device 1 includes: a cover 2, a nozzle 3, and vacuum suctioning means 4, as shown in FIG. 1. The cover 2 is formed as a hollow box shape that opens toward at least one surface. In FIG. 1, the cover 2 is formed as a hollow box shape that opens downwardly. This cover 2 faces an opening toward a cleaning target surface 5 and is used by being arranged on a wall surface, etc., of the fine-particle processing device. The cleaning target surface 5 is that to which fine particles (dry powder and/or wet powder) 6 adhere, i.e., that to which the fine particles 6 actually adhere or possibly adhere. The cleaning target surface 5 may be a flat surface without irregularities, or a surface with regular or irregular irregularities.

The cover 2 is covered on the cleaning target surface 5 but does not necessarily cover a whole of the cleaning target surface 5 and may suffice to cover a part of the cleaning target surface 5. Also when the cover 2 locally covers the cleaning target surface 5, the cover 2 can be moved relative to the cleaning target surface 5 to allow wide area cleaning.

The cover 2 is provided with a nozzle 3 for injecting a fluid toward the opening. The nozzle 3 is supplied with a pressurized fluid, which is injected toward the opening of the cover 2. Therefore, when the fluid is injected from the nozzle 3 in a state that the cover 2 is covered on the cleaning target surface 5, the fine particles 6 adhering to the cleaning target surface 5 are caused to be detached by the fluid from the nozzle 3. Examples of the fluid injected from the nozzle 3 include but are not limited to water, steam, air, alcohol, and detergent. Heated fluid can be injected from the nozzle 3. For example, warm water, hot water, warm air, or hot air may be injected from the nozzle 3.

The nozzle 3 can be configured to inject one type of fluid (desired liquid or gas), or can be configured to inject two or more types of fluid (a desired liquid, gas, etc.). When a combined nozzle such as the latter is used, for example, water and air; or water and detergent can be injected from the nozzle 3. However, as an alternative to using the combined nozzle, a plurality of nozzles 3 can be provided for one cover 2.

The fluid within a space 7 formed between the cover 2 and the cleaning target surface 5 is suctioned and discharged to the outside by the vacuum suctioning means 4. Thereby, in the space within the cover 2, a pressure is kept more negative than that in the space outside of the cover 2. Therefore, the fluid (liquid and/or gas) injected from the nozzle 3 and the fine particles 6 detached from the cleaning target surface 5 by that fluid are prevented from splattering outside of the cover 2. That is, the fluid injected from the nozzle 3 and the fine particles 6 detached from the cleaning target surface 5 by the fluid are suctioned and discharged by the vacuum suctioning means 4.

Typically, the vacuum suctioning means 4 is configured by, but is not limited to, a vacuum pump. An exhaust path 8 for connecting the cover 2 to the vacuum suctioning means 4 may be formed with a strainer and a filter for removing the suctioned fine particles 6. As an alternative or a supplement to that, the exhaust path 8 may be formed with a steam-water separator. The cover 2 may be formed with a plurality of vacuum connection ports 9.

The cleaning device 1 thus configured is preferably capable of moving relative to the cleaning target surface 5. In that case, the cover 2 can be moved relative to the cleaning target surface 5 of which the position is fixed, or conversely, the cleaning target surface 5 can be moved relative to the cover 2 of which the position is fixed. Alternatively, both the cover 2 and the cleaning target surface 5 can be moved. When the cover 2 and the cleaning target surface 5 are moved relative to each other, wide range cleaning can be enabled with a compact configuration.

When the cover 2 and the cleaning target surface 5 are moved relative to each other, the cover 2 can be arranged as close as possible to, but preferably not in contact with, the cleaning target surface 5. Thereby, the fluid injected from the nozzle 3 and the fine particles 6 detached by the fluid are prevented from leaking to the outside of the cover 2, while enabling smooth relative movement between the cover 2 and the cleaning target surface 5. However, in FIG. 1, it can be configured so that a lower end of the cover 2 is formed with such as wheels to move relative while the wheels are in contact with the cleaning target surface 5.

According to the cleaning device 1 of the present embodiment, the cover 2 is covered on the cleaning target surface 5, and then, the fluid is injected from the nozzle 3. In this way, the fine particles 6 adhering to the cleaning target surface 5 can be detached and removed. At this time, the injected fluid from the nozzle 3 and the fine particles 6 detached thereby are suctioned by the vacuum suctioning means 4, thus preventing splattering to the outside of the cover 2. The cover 2 is locally provided on the cleaning target surface 5 but is moved relative to the cleaning target surface 5, thereby enabling cleaning of the whole cleaning target surface 5.

Figure 2:
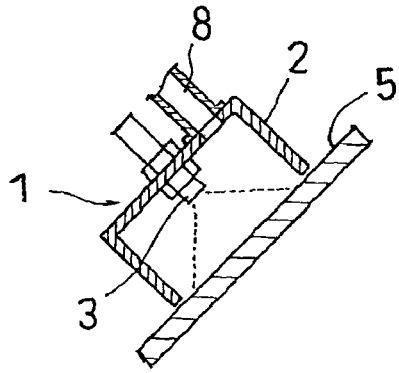
FIG. 2 is a diagram of the cleaning device in FIG. 1 to be used on an inclined surface.
Figure 3:
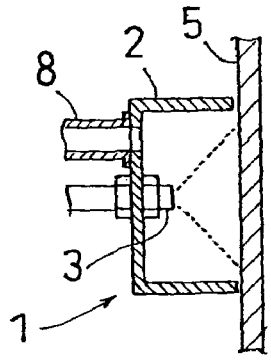
FIG. 3 is a diagram of the cleaning device in FIG. 1 to be used on a vertical surface.
Figure 4:
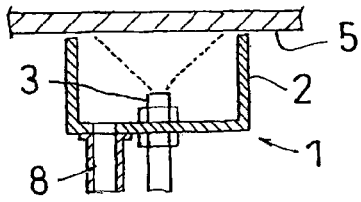
FIG. 4 is a diagram of the cleaning device in FIG. 1 to be used when the cleaning device faces an upward direction.

The configuration of the cleaning device 1 according to the present embodiment may be such that: a negative pressure is maintained inside the cover 2; and a pressurized cleaning fluid injected from the nozzle 3 and the fine particles 6 detached thereby from the cleaning target surface are collected. Therefore, the cleaning target surface 5 can be an inclined surface as shown in FIG. 2 or a vertical surface as shown in FIG. 3, rather than a horizontal surface as shown in FIG. 1. The cleaning target surface 5 can also be a downwardly sloping surface as shown in FIG. 4, rather than an upwardly sloping surface as shown in FIG. 1. In this way, the cleaning device 1 can be used with the opening of the cover 2 facing in any direction.

Figure 5:
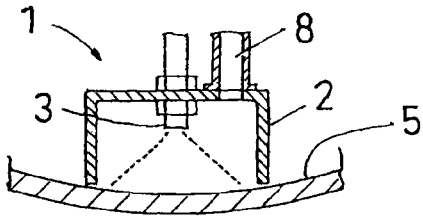
FIG. 5 is a diagram of the cleaning device in FIG. 1 to be used on a circularly arcing curved surface.
Figure 6:
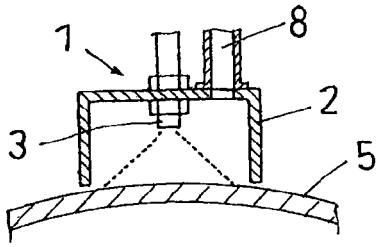
FIG. 6 is a diagram of the cleaning device in FIG. 1 to be used on a spherical surface.
Figure 7:
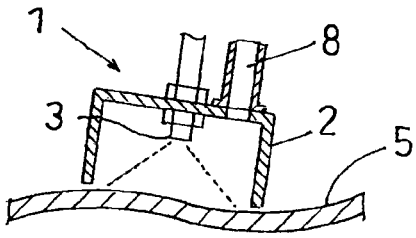
FIG. 7 is a diagram of the cleaning device in FIG. 1 to be used on an arbitrarily-shaped curved surface.
Figure 8:
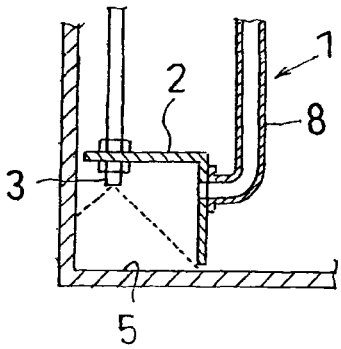
FIG. 8 is a diagram showing a usage state of a modified example of the cleaning device in FIG. 1.
Figure 9:
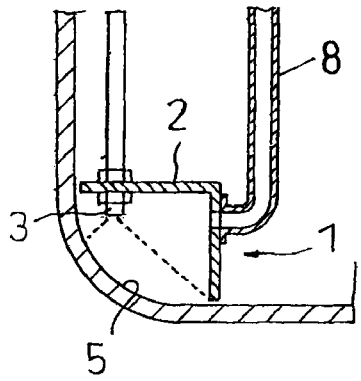
FIG. 9 is a diagram showing a usage state of another modified example of the cleaning device in FIG. 1.

The cleaning target surface 5 can be any curved surface such as a cylindrical surface or a spherical surface rather than a flat surface. For example, it can be a circularly arcing curved surface as shown in FIG. 5, a spherical surface as shown in FIG. 6, or such other curved surface as shown in FIG. 7. Additionally, as shown in FIG. 8 and FIG. 9, one or a plurality of sidewalls of the cover 2 can be omitted or notched to enable cleaning of corner parts.

Figure 10:
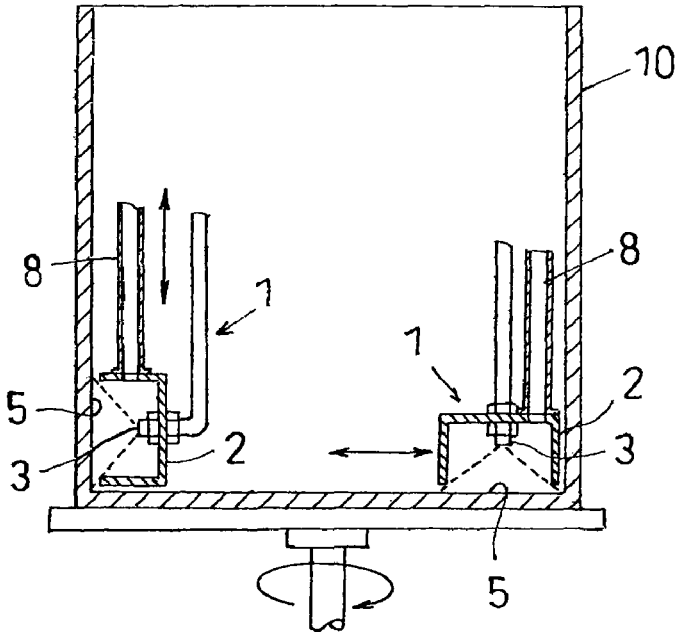
FIG. 10 is a diagram of the cleaning device in FIG. 1 to be used in a rotating cylinder.

As described above, the cover 2 is moved relative to the cleaning target surface 5. This relative movement can be provided, for example, by using a robot arm, a table, etc. When a surface of a rotating disc is the cleaning target surface, the cover 2 can be arranged simply on a circumferential part of the rotating disc to enable cleaning entire circumferential ranges. In this case, when the cover 2 is moved in a radial direction of the disc to perform the cleaning, the entire disc can be cleaned. As shown in FIG. 10, the same is applicable when a bottom surface of the rotating cylinder 10 is the cleaning target surface 5.

FIG. 10 also shows a case where a circumferential side surface of the rotating cylinder 10 is the cleaning target surface 5, in which case also, the cover 2 can also be arranged simply on a circumferential part of the rotating cylinder 10 to enable cleaning the entire circumferential ranges. In this case, when the cover 2 is moved in an axial direction of the cylinder 10 to perform the cleaning, an entire circumferential side surface of the cylinder 10 can be cleaned.

Figure 11:
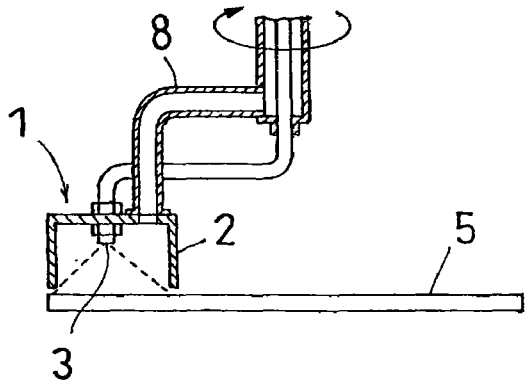
FIG. 11 is a diagram of the cleaning device in FIG. 1 to be used on a fixed disc.
Figure 12:
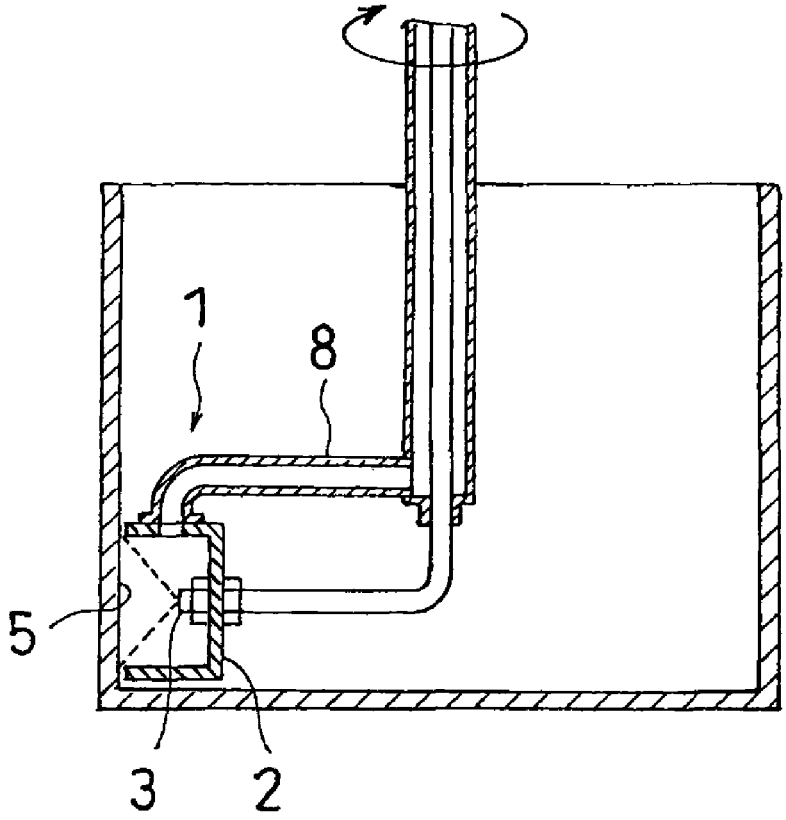
FIG. 12 is a diagram of the cleaning device in FIG. 1 to be used in a fixed cylinder.

Instead of rotating the disc, the cover 2 can be rotated around an axis as shown in FIG. 11. Additionally, instead of rotating the cylinder, the cover 2 can be rotated around an axis as shown in FIG. 12.

Other than the above, such as a robot arm, etc., can be used for configuration so that the cover 2 is separate from the cleaning target surface 5 except during a cleaning time. Additionally, a plurality of covers 2 can be installed in a single fine-particle processing device. Moreover, such as a robot arm, etc., can be employed to use one cover 2 for a plurality of fine-particle processing devices. Furthermore, the cover 2 can be housed in the fine-particle processing device, except during a cleaning time. In this case, such as an air cylinder, etc., can be used to alternatively arrange the cover 2 in either a cleaning position or a housing position.

The cleaning device 1 can be assembled into the fine-particle processing device to form a fine-particle processing device with a cleaning device. For example, the above-described cleaning device 1 can be assembled into a spheronizer for transforming columnar particles, which are fed in a wet condition, into spherical shapes.

A spheronizer according to one embodiment of the present invention includes a case having a cylindrical wall surface as a processing container. A particle-regulating disc is rotatably retained on the bottom of the cylindrical case inside. An outer circumferential edge of the particle-regulating disc rotates as close as possible to an inner circumferential surface of the case. A top surface of the particle-regulating disc is formed with irregularities.

A part of the outer circumference of the particle-regulating disc is provided with a cover with the nozzle. This cover is alternatively arranged in one of a cleaning position in which the cover is arranged as close as possible to, but is not in contact with, the top surface of the particle-regulating disc, and a housing position in which the cover is moved further upward or radially outward. For example, in the cleaning position, the cover projects inwardly from a circumferential sidewall of the case, whereas in the housing position, the cover is retracted to a position where a projected side end surface is arranged to be flush with an inner circumferential surface of the case.

As described above, the nozzle is provided within the cover. This nozzle can inject the fluid to a location covered with the cover, within the top surface of the particle-regulating disc. As described above, the cover also is connected with the vacuum suctioning means. This vacuum suctioning means suctions and discharges to the outside, the fluid within a space formed between the cover and the top surface of the particle-regulating disc.

The spheronizer may further include an auxiliary nozzle for injecting air downwardly into a gap between the inner circumferential surface of the case and the outer circumferential edge of the particle-regulating disc. When the auxiliary nozzle is used to inject air into the gap from above the particle-regulating disc, a vacuum suction may preferably be directed from below the particle-regulating disc. Thus, even when water from the nozzle leaks to the outside of the cover, thereby adhering to the inner circumferential surface of the case due to centrifugal force caused by the rotation of the particle-regulating disc, pressurized air from above and the vacuum suction from below can smoothly discharge the water downwardly of the particle-regulating disc.

EXAMPLE

Hereinafter, based on the drawings, a specific example of the present invention is described in detail.

Figure 13:
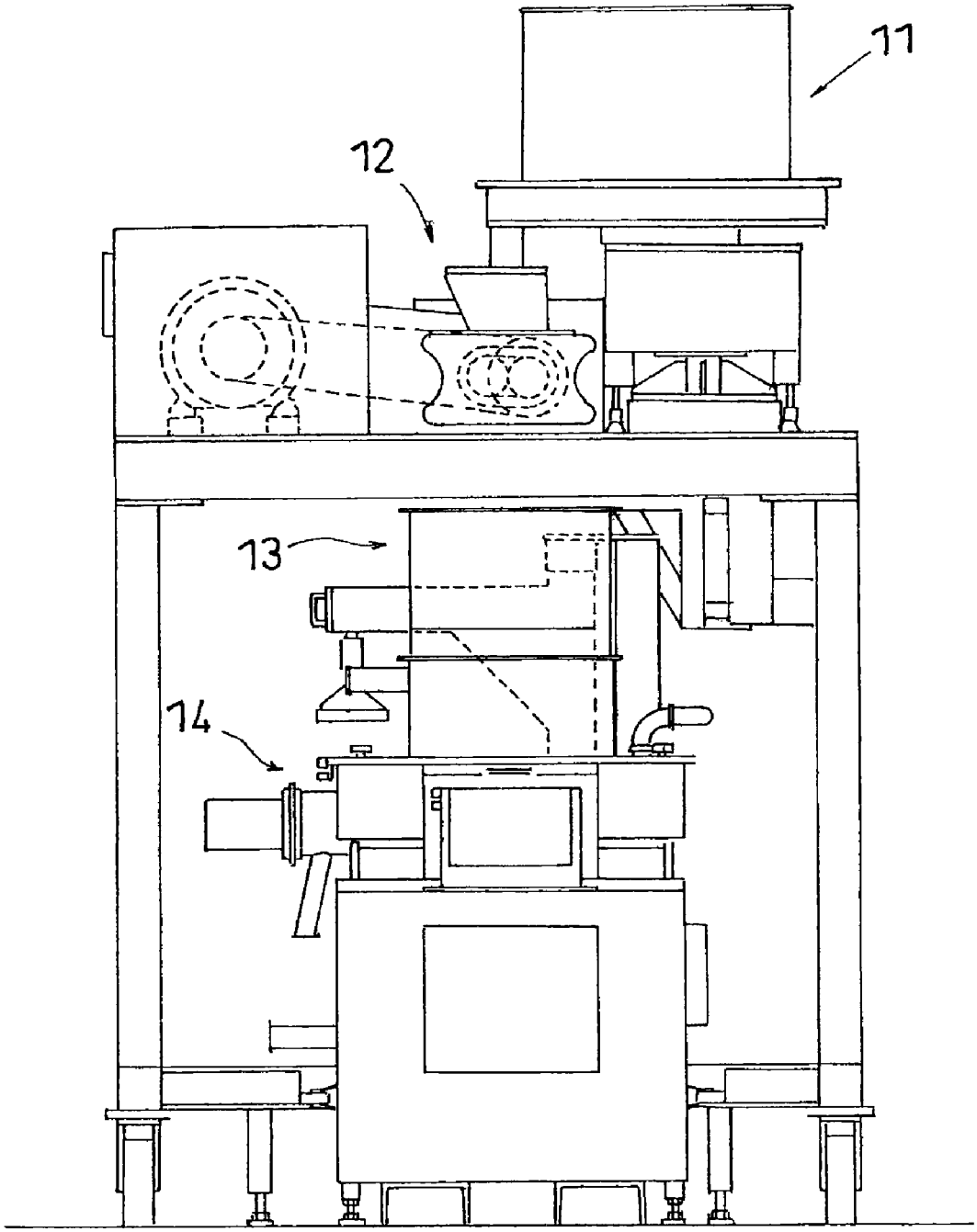
FIG. 13 is a front view showing one example of a fine-particle processing system in which one embodiment of the cleaning device of the present invention is applied.
Figure 14:
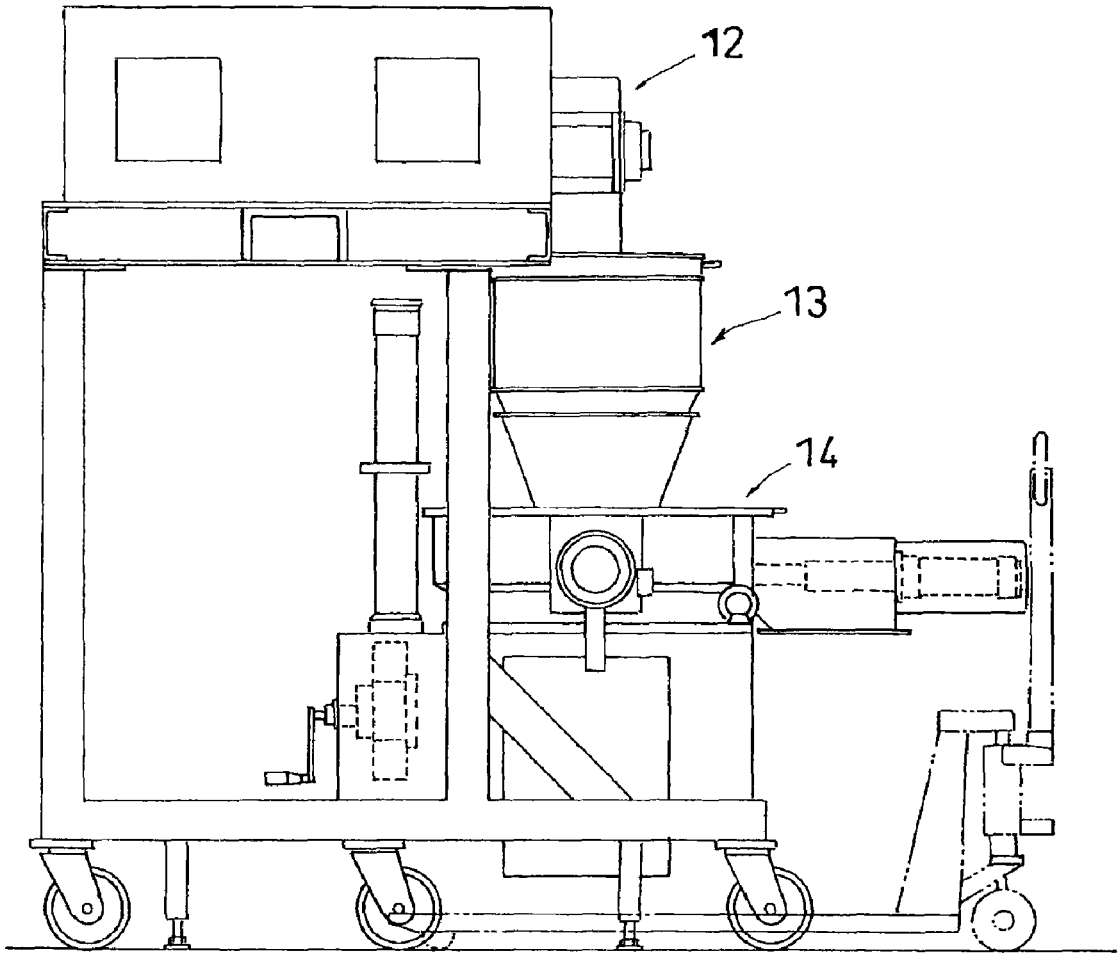
FIG. 14 is a side view of the fine-particle processing system in FIG. 13.

FIG. 13 and FIG. 14 show one example of a fine-particle processing system. FIG. 13 shows a front view, and FIG. 14 shows a side view. The fine-particle processing system is configured by combining a plurality of fine-particle processing devices. The type and combination of fine-particle processing devices are designed according to the system, but the illustrated fine-particle processing system is provided with: a material supplier 11; an extrusion granulator 12; a hopper 13; and a spheronizer 14.

The material supplier 11 supplies a kneaded material to the extrusion granulator 12. The extrusion granulator 12 is supplied with the kneaded material from the material supplier 11, thereby manufacturing a granulated product from the kneaded material. Specifically, a wet columnar granulated product is manufactured. The hopper 13 temporarily stores the granulated product from the extrusion granulator 12, and supplies the granulated product to the spheronizer 14 as needed. The spheronizer 14 is supplied with the wet columnar granulated product from the hopper 13 and pulverizes the columnar granulated product as needed to transform them into spherical shapes. This spheronizer 14 is assembled with one example of the cleaning device according to the present invention, as described later.

Figure 15:
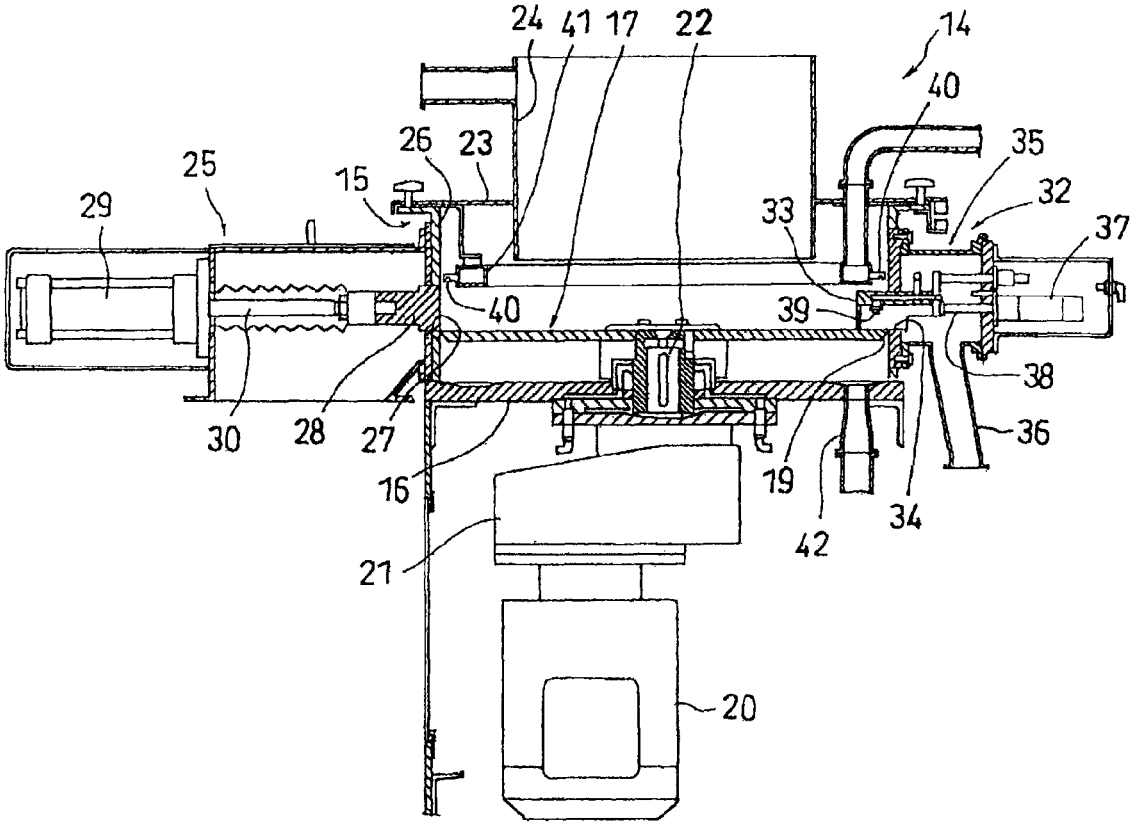
FIG. 15 is a longitudinal cross-sectional view showing one example of a spheronizer including one embodiment of the cleaning device of the present invention.
Figure 16:
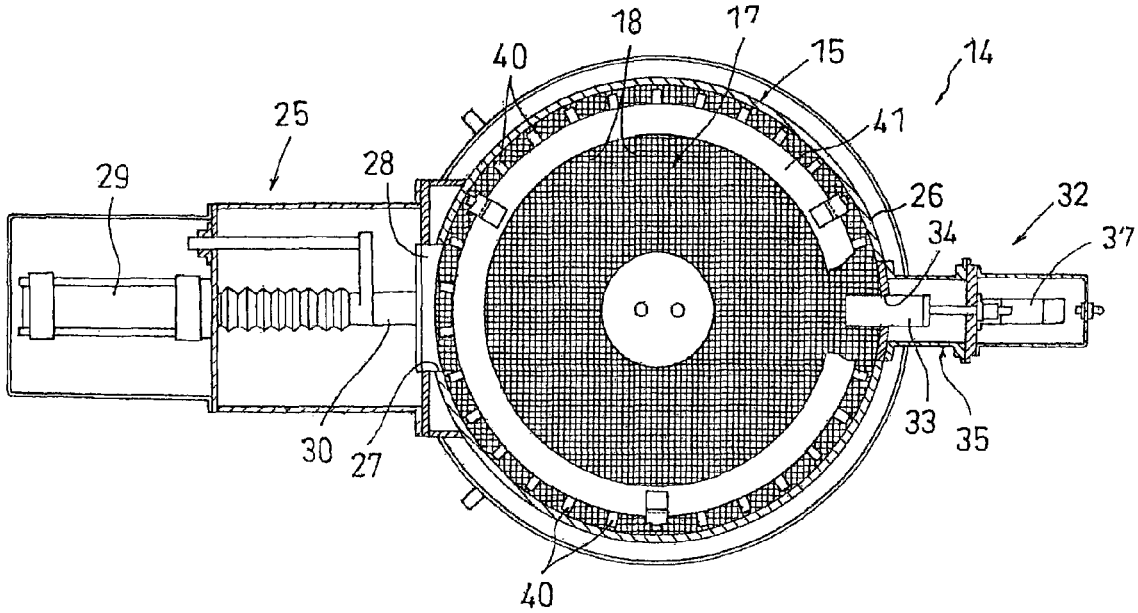
FIG. 16 is a plane view of the spheronizer in FIG. 15.

FIG. 15 and FIG. 16 show an example of the spheronizer 14 provided with one example of the cleaning device according to the present invention. FIG. 15 shows a longitudinal sectional view, and FIG. 16 shows a plane view. The spheronizer 14 according to the example includes a cylindrical case 15 that opens in an upward direction, as a processing container. Within the case 15, a particle-regulating disc 17 is upwardly spaced separate from a bottom wall 16 of the case 15 and is rotatably retained horizontally.

Figure 17:
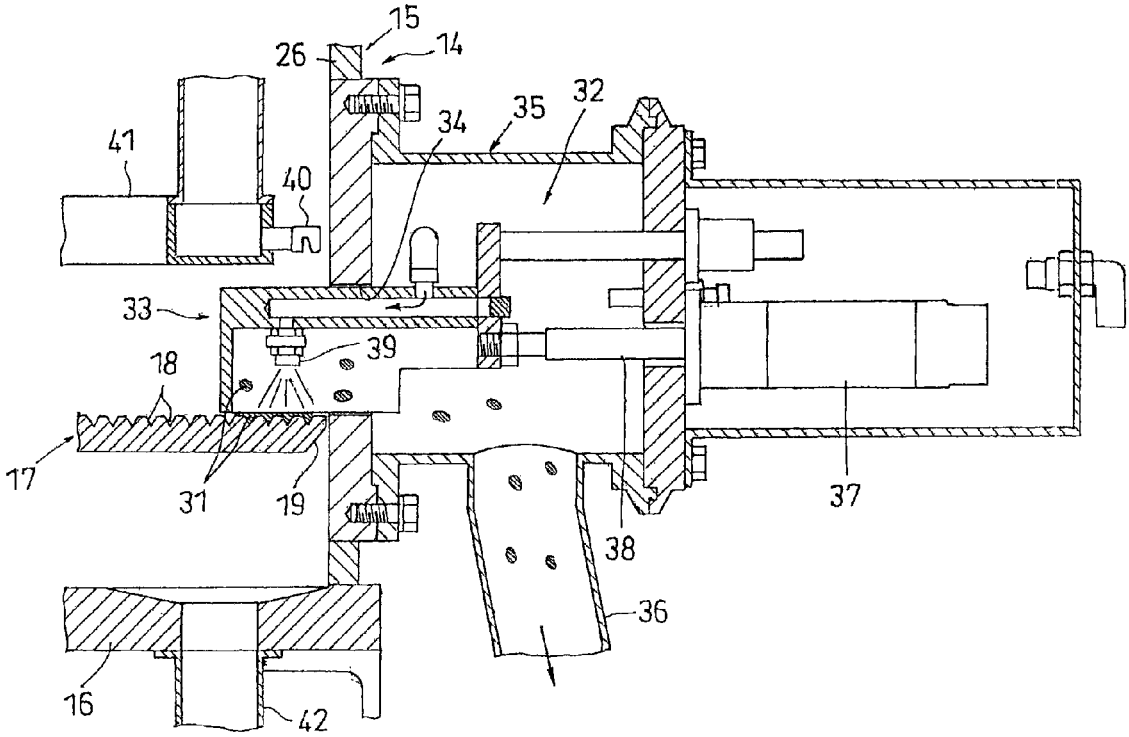
FIG. 17 is a longitudinal cross-sectional view showing the cleaning device of the spheronizer in FIG. 15, in which a cover is at a cleaning position.

The particle-regulating disc 17 is a disc of which a top surface is formed with appropriate irregularities. In the illustrative example, grid-like fine grooves 18, 18, . . . are formed, but a combination of concentric grooves and grooves extending in a radial direction may be possible. Rather than forming the grooves, projections can alternatively be formed. The shape of the groove or the projection on the top surface of the particle-regulating disc 17 can be designed as needed. A cross-sectional shape of the groove or the projection is not limited, but in this example, grooves 18 are those having a cross-section of an inverted triangle, as shown in FIG. 17.

An outer circumferential surface 19 of the particle-regulating disc 17 is formed to be inclined outwardly in a radial direction, as viewed toward an upward direction. An outermost diameter of the particle-regulating disc 17 (outer diameter of the top surface) is slightly smaller than an inner diameter of the case 15. Thereby, an outer circumferential edge of the top surface of the particle-regulating disc 17 is arranged to be substantially in close proximal contact with the inner surface of the case 15.

The particle-regulating disc 17 can be rotated by a motor 20. The motor 20 is provided in a lower part of the case 15. A rotary drive force of the motor 20 is transmitted to a drive axis 22 via a reducer 21. The drive axis 22 penetrates longitudinally through the bottom wall 16 of the case 15 and is connected to a central part of the particle-regulating disc 17. Thereby, when the motor 20 is driven, the drive axis 22 rotates the particle-regulating disc 17.

An upper opening of the case 15 is formed with a cover plate 23, and a central part of the cover plate 23 is formed with a material-feeding cylinder 24. Via the material-feeding cylinder 24, a material can be supplied within the case 15. That is, the wet columnar granulated product from the extrusion granulator 12 can be supplied within the case 15 via the hopper 13 and the material-feeding cylinder 24.

In a state that the particle-regulating disc 17 is rotated at a high speed, when the wet columnar granulated product is supplied within the case 15, the columnar granulated product is pulverized as needed to be transformed into a spherical shape. The resultant spherically-shaped particle-regulated products are extracted via a discharging device 25.

The discharging device 25 is provided on a part of a circumferential direction of the case 15. Specifically, a part of the circumferential sidewall 26 of the case 15 is formed with a discharging vent 27 at a height corresponding to the top surface of the particle-regulating disc 17. The discharging vent 27 can be opened and closed by a discharging cover 28. The discharging cover 28 can be moved forward and backward by an air cylinder 29 in a radial direction of the case 15. In a state that a rod 30 in the air cylinder 29 is extended, the discharging cover 28 closes the discharging vent 27. In such a state, a tip end surface of the discharging cover 28 is flush with an inner circumferential surface of the case 15. Meanwhile, in a state that the rod 30 in the air cylinder 29 is contracted, the discharging cover 28 is retracted outwardly in a radial direction from the case 15 to open the discharging vent 27. Accordingly, when the discharging vent 27 is opened in a state that the particle-regulating disc 17 is rotated, the particle-regulated products can be discharged by centrifugal force from the discharging vent 27 to the outside of the case 15.

As the spheronizer 14 is operated, the irregularities (the grooves 18 in this example) of the particle-regulating disc 17 may become clogged with the wet powder 31 (FIG. 17) generated from the material. In particular, the irregularities easily become clogged on the outer circumference of the particle-regulating disc 17. To eliminate such clogging, the case 15 of the spheronizer 14 is provided with a cleaning device 32 at a position facing the discharging device 25. The spheronizer 14 is batch-operated, and thus, the cleaning device 32 can conduct cleaning of the particle-regulating disc 17 between batches.

Figure 18:
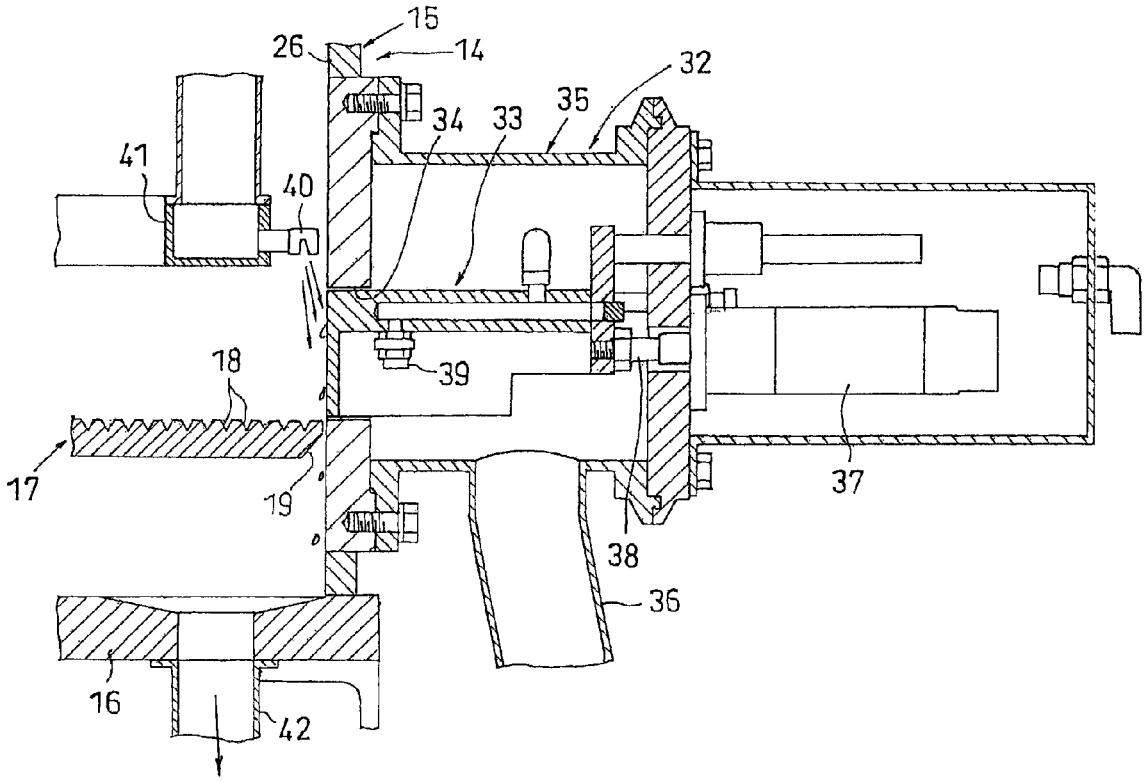
FIG. 18 is a longitudinal cross-sectional view showing the cleaning device of the spheronizer in FIG. 15, in which the cover is at a housing position.

FIG. 17 and FIG. 18 respectively show a longitudinal sectional view of one example of the cleaning device 32. FIG. 17 shows a state that a cover 33 is in a cleaning position, and FIG. 18 shows a state that the cover 33 is in a housing position. The circumferential sidewall 26 of the case 15 is formed with a rectangular through-hole 34 at a height corresponding to the top surface of the particle-regulating disc 17. More specifically, the rectangular through-hole 34 is arranged so that a lower edge thereof is arranged at a height corresponding to the top surface of the particle-regulating disc 17. Via the through-hole 34, the cover 33 of the cleaning device 32 can protrude into the case 15. The cover 33 is formed in a rectangular box shape that opens to a lower side and a proximal side (right side in FIG. 17).

At an outer circumference of the case 15, a hollow box-like outer cover 35 is fixed at a position corresponding to a position at which the through-hole 34 is formed. The outer cover 35 is connected to the vacuum suctioning means (not shown) via vacuum connection port 36. For the vacuum suctioning means, a vacuum pump (not shown) is used in this example. Accordingly, once the vacuum pump is activated, the fluid within the outer cover 35 and thus within the cover 33 is suctioned and discharged to the outside.

The cover 33 can be moved forward and backward by an air cylinder 37 in a radial direction of the case 15. In a state that a rod 38 of the air cylinder 37 is extended (i.e., in the cleaning position), a tip end of the cover 33 is projected into the case 15, as shown in FIG. 17. In such a state, the tip end of the cover 33 is covered by a part of the outer circumference of the particle-regulating disc 17. Meanwhile, in a state that the rod 38 of the air cylinder 37 is contracted (i.e., in the housing position), the cover 33 is retracted to a position at which a tip end surface thereof is flush with the inner circumferential surface of the case 15, as shown in FIG. 18. In such a state, the through-hole 34 provided on the circumferential sidewall 26 of the case 15 is sealed by the tip end surface of the cover 33.

An upper part within the cover 33 is formed with a fluid nozzle 39 to be situated downwardly. In a state that the cover 33 is in the cleaning position, the nozzle 39 is supplied with a pressurized fluid, which is injected to a location, covered by the cover 33, of the particle-regulating disc 17. The nozzle 39 in the example is not conical and injects the fluid in a fan-like spray within a vertical plane radially along the particle-regulating disc 17. Water is used as the fluid to be injected from the nozzle 39 in this example, but it is not limited to this.

A cleaning operation is performed by arranging the cover 33 in the cleaning position in a state that the particle-regulating disc 17 is rotated, as shown in FIG. 17. In this case, in a state that the vacuum pump is activated, the water is injected downwardly from the nozzle 39. Thereby, the wet powder 31 adhering to the particle-regulating disc 17 is detached by the water from the nozzle 39, and the detached powder and the water from the nozzle 39 are suctioned and discharged by the vacuum pump to the outside. As a result, the particle-regulating disc 17 can be cleaned, while preventing the water from splattering to the outside of the cover 33.

However, the particle-regulating disc 17 has the irregularities and the water is used for cleaning, and thus, there is a possibility that not all of the water that intrudes into the concave parts of the particle-regulating disc 17 may be collected by the vacuum pump, depending on the design conditions. In this case, uncollected water, which may constitute only a small amount, may adhere to the inner circumferential surface of the case 15 due to the centrifugal force caused by the rotation of the particle-regulating disc 17. In view of this, an auxiliary nozzle 40 may be provided to remove the water adhering to the inner circumferential surface of the case 15.

In the example, an annular manifold 41 is provided at an upper part within the case 15. The manifold 41 is formed in a hollow-piped shape, and an outer circumference thereof is provided with a plurality of auxiliary nozzles 40 at circumferentially equal intervals. Because of such a configuration, air supplied to the manifold 41 is injected downwardly from each auxiliary nozzle 40. Specifically, the air is injected downwardly along the inner circumferential surface of the case 15. Additionally, in conjunction with this, the vacuum pump induces a vacuum suction from the lower part of the case 15. Specifically, the vacuum connection port 42 of the bottom wall 16 of the case 15 is connected with the vacuum pump to induce the vacuum suction.

In this way, the pressurized air from above the particle-regulating disc 17 and the vacuum suction from below the particle-regulating disc 17 are used to enable discharging the water adhering to the case 15 within a short time. In addition, in cases where the irregularities of the particle-regulating disc 17 are small, or the particle-regulating disc 17 has no irregularities, or a cleaning fluid from the nozzle 39 is air, water drainage by the auxiliary nozzle 40 is not necessary. In FIG. 18, an operation is carried out when the case 15 is in the housing position. Also in a cleaning time in FIG. 17, the water drainage operation using the auxiliary nozzle 40 can be simultaneously performed.

As described above, according to the cleaning device 32 of the example and the spheronizer 14 therewith, the cleaning can be performed easily, rapidly, and reliably without disintegrating the spheronizer 14. Further, a cleaning operation can be performed without stopping the operation of the spheronizer 14.

The cleaning device 32 of the present invention and the fine-particle processing device therewith can be changed as needed without limiting the configurations of the above example. For example, in the above example, the cleaning device 32 is provided in the spheronizer 14, but the cleaning device can also be provided in other fine-particle processing devices.

Additionally, the cleaning device 32 can be configured so that the cover 33 is locally covered on the cleaning target surface and the vacuum suction is induced from within the cover 33, and at the same time, the fluid is injected from the nozzle 39 toward the cleaning target surface and the cover 33 and the cleaning target surface are moved relative to each other. The configuration can be changed as needed.

The invention claimed is:

1. A fine-particle processing device for transforming columnar particles, fed in a wet condition, into spherical shapes, comprising:

a case having a cylindrical wall surface, wherein the case has an opening where columnar particles are fed through in a wet condition, and a discharging vent on the wall where regulated particles are discharged from;

a particle-regulating disc formed of a disc of which a top surface is formed with irregularities, the particle-regulating disc being rotated with an outer circumferential edge thereof proximate to an inner circumferential surface of the case;

a cover at a part of an outer circumference of the particle-regulating disc, the cover being alternatively arranged in one of: a cleaning position in which the cover is arranged proximate to, but is not in contact with, a top surface of the particle-regulating disc; and a housing position in which the cover is moved further upward or outward, a nozzle for injecting a fluid to a location covered with the cover, within the top surface of the particle-regulating disc, and a vacuum suctioning means for suctioning and discharging to the outside a fluid in the space formed between the cover and the top surface of the particle-regulating disc to the outside of the space.

2. The fine-particle processing device according to claim 1, wherein the cover is projected inwardly from a circumferential sidewall of the case in the cleaning position, while the cover is retracted to a position at which a projected side end surface is flush with an inner circumferential surface of the case in the housing position.

3. The fine-particle processing device according to claim 2, further comprising an auxiliary nozzle for injecting air into a gap between the inner circumferential surface of the case and an outer circumferential edge of the particle-regulating disc.

* * * * *